US010587359B2

(12) United States Patent
Bromberg et al.

(10) Patent No.: US 10,587,359 B2
(45) Date of Patent: Mar. 10, 2020

(54) METHOD AND SYSTEM OF REACTIVE INTERFERER DETECTION

(71) Applicant: BAE SYSTEMS Information and Electronic Systems Integration Inc., Nashua, NH (US)

(72) Inventors: Matthew C Bromberg, Leominster, MA (US); Dianne E Egnor, Catonsville, MD (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 551 days.

(21) Appl. No.: 15/352,697

(22) Filed: Nov. 16, 2016

(65) Prior Publication Data

US 2017/0139034 A1 May 18, 2017

Related U.S. Application Data

(60) Provisional application No. 62/255,781, filed on Nov. 16, 2015.

(51) Int. Cl.
*H04K 3/00* (2006.01)

(52) U.S. Cl.
CPC ..... *H04K 3/224* (2013.01); *H04K 3/45* (2013.01); *H04K 3/46* (2013.01); *H04K 3/28* (2013.01)

(58) Field of Classification Search
None
See application file for complete search history.

(56) References Cited

U.S. PATENT DOCUMENTS

| | | | | |
|---|---|---|---|---|
| 8,351,842 | B2 * | 1/2013 | Hori | H04K 3/228 455/1 |
| 2007/0192870 | A1 * | 8/2007 | Lynn | H04L 41/0893 726/26 |
| 2012/0051239 | A1 * | 3/2012 | Thai | H04K 3/224 370/252 |
| 2014/0347978 | A1 * | 11/2014 | Kim | H04L 45/22 370/225 |
| 2016/0127404 | A1 * | 5/2016 | Baxley | G06F 16/285 726/22 |
| 2017/0026205 | A1 * | 1/2017 | Agee | H04L 25/08 |
| 2017/0261615 | A1 * | 9/2017 | Ying | G01S 19/21 |

* cited by examiner

*Primary Examiner* — Vladimir Magloire
*Assistant Examiner* — Donald HB Braswell
(74) *Attorney, Agent, or Firm* — Maine Cernota & Rardin; Scott J. Asmus

(57) ABSTRACT

A method and system of reliably detecting a reactive jamming attack and estimating the jammer's listening interval for exploitation by a communication system comprises channelizing one or more signals of interest (SOI), channelizing one or more signals of unknown origin (SUO), identifying frequency support patterns for the SOI and SUO using Bayes thresholds, comparing SOI and SUO detection map histories, and determining a percent match, where a match percentage above a specified minimum indicates a reactive attack. Edge detection can be used to enhance jammer support. Embodiments further detect reactive jammer adaptation to changes in the SOI's frequency support. Embodiments include detectors that are insensitive to jammer modulation and/or signal type. A jammer reaction delay and/or size and periodicity of receive window can be detected. Embodiments determine if a jammer is copying and retransmitting the SOI's waveform(s), and/or if the jammer is anticipatory.

17 Claims, 8 Drawing Sheets

METHOD AND SYSTEM OF REACTIVE INTERFERER DETECTION

RELATED APPLICATIONS

This application claims the benefit of U.S. Provisional Application No. 62/255,781, filed Nov. 16, 2015, which is herein incorporated by reference in its entirety for all purposes.

STATEMENT OF GOVERNMENT INTEREST

This invention was made with U.S. Government support under Contract No. FA8750-11-C-0189 awarded by the United States Air Force. The U.S. Government has certain rights in this invention.

FIELD

This invention relates to the field of communication, and more particularly to characterizing reactive jamming of wireless communications.

BACKGROUND

Due to the ever increasing dependence on wireless communication in both civilian and military environments, the blocking of wireless communication, i.e., jamming, is one of the major security threats that must be addressed. Several jammer categories have been identified, according to their channel-awareness and "statefulness." Traditionally, constant and random jammers have been the prevalent approaches to jamming, because they are easy to implement. However, these methods lack channel-awareness, and are generally inefficient in blocking communications, especially when the "signals of interest" (SOI's) utilize sophisticated protocols such as "channel-hopping." In addition, constant or random jamming is relatively easy to detect, and therefore disadvantageous for hostile entities that may wish to elude detection and apprehension.

On the other end of the spectrum, reactive jammers which target only packets that are already "on the air," base their jamming decisions on both the current and previous channel states of the SOI. This allows for effective and efficient jamming, because only short jamming bursts are required to interfere with packets. In particular, reactive jamming enables the implementation of optimal jamming strategies, since channel-awareness is a major factor for such strategies. For example, it has been shown that a reactive jammer can be four orders of magnitude more efficient than a pre-emptive jammer. Furthermore, by corrupting the reception of only selected packets, only limited interference with other nodes is experienced, thereby minimizing the risk of detection.

Detection and characterization of reactive jamming requires that received signals must be analyzed to determine if they include significant interactions and correlations with the SOI. Currently, such estimations of interactions between communications systems and a periodic jammer that is recording and replaying receptions of the communication system are calculated using blind estimation. This current method is inaccurate and produces too many errors.

What is needed, therefore, are improved techniques for reliable detection and characterization of reactive jamming attacks.

SUMMARY

An improved system and method is disclosed of reliably detecting a reactive jamming attack and estimating the jammer's listening interval for exploitation by a communication system.

The disclosed method comprises channelizing one or more signals of interest (SOI), channelizing one or more interferer signals, identifying support for the SOI and interferer signals using Bayes thresholds, comparing SOI and interferer detection map histories, and determining a percent match, whereby in embodiments an attack is indicated if the percent match is above a predetermined minimum value.

Embodiments identify jammers that track the frequency support of a signal of interest (SOI). In certain embodiments, the system further analyzes whether the jammer is reacting to changes in the SOI's frequency support, and in some of these embodiments the system determines how well the reactive jammer tracks the SOI's frequency set.

Various embodiments include detectors that are insensitive to jammer modulation or signal type. In certain embodiments, for example where the primary concern is if the jammer overlaps with the SOI's frequency support, the system estimates, if possible, the reaction delay and the size and periodicity of a jammer's receive window. And in certain embodiments, the system determines if the jammer is copying and retransmitting the SOI's waveform(s).

In embodiments, the system can determine if a jammer is purely reactive, i.e. merely reacts to energy in its receiving window, or is also anticipatory.

In some embodiments where there is a need for the jammer detection to be robust in the presence of impairments, the invention assesses SOI "leakage" into the jammer waveform, i.e. the residual energy from the SOI that is included erroneously with the jammer waveform due to imperfect decomposing of the received signal into SOI and jammer waveforms. And in various embodiments, the disclosed system is effective even when the jammer receive window parameters are unknown.

In certain embodiments, the disclosed system does not rely on any prior information about the jammer or its capabilities, and is effective over a diverse range of relationships between what the jammer records and what it transmits (e.g., IFFT/FFT, DRFM, detect/follow, and the like). In embodiments the system is able to detect and characterize jammers that employ only reactive interference, for example if the jammer is listening and replaying what it has heard (e.g. radar applications, telecommunications, etc.).

In embodiments, the disclosed method further comprises utilizing edge detection to obtain a receiver gate for improved time/frequency support detection. Some embodiments further comprise evaluating the likelihood that the interferer is reacting to the behavior of the SOI.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present disclosure is an improved system and method of reliably detecting a reactive jamming attack and estimating the jammer's listening interval for exploitation by a communication system.

In particular, the system and method compares time/frequency detection maps of communications systems to time/frequency detection maps of jammers or other interferers. Certain embodiments perform this comparison while being aware of times when the SOI communication system is not sensing the environment, typically because it is transmitting.

Figure 1:
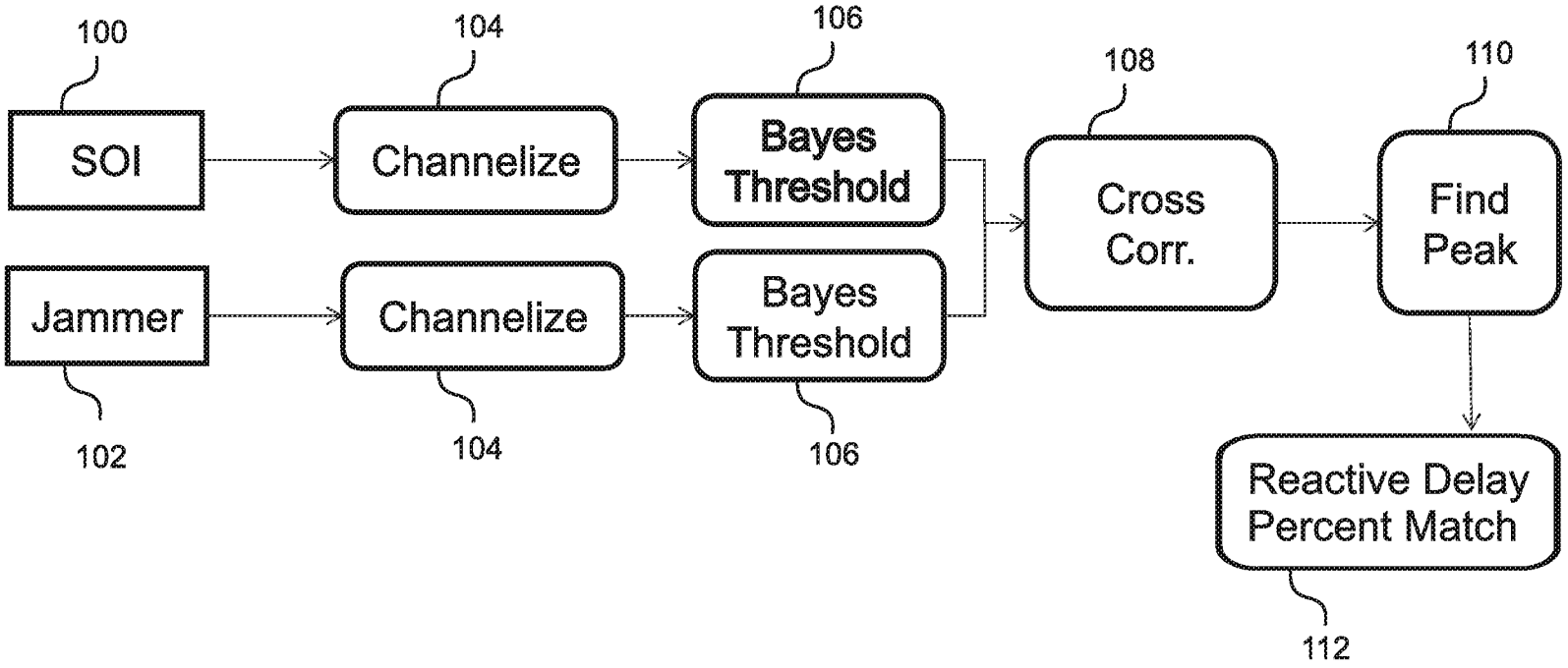
FIG. 1 is a flow diagram that illustrates the operation of a time/frequency support detector in an embodiment of the present system.

FIG. 1 is a flow diagram of a time/frequency support detector in an embodiment that detects jamming attacks based on correlations between the frequency support of the attack and the frequency support of the SOI. Specifically, in the embodiment of FIG. 1, a time/frequency transform is applied to "channelize" 104 both a SOI 100 and a jammer signal 102, after which Bayesian threshold 106 is applied so as to identify the frequency support in each case. In the embodiment of FIG. 1, the two values are cross-correlated 108 and a peak is detected 110, from which the reactive delay of the jamming signal and a percentage value of the match is determined 112. In embodiments, the probability P of a jammer detection is given by the formula:

$$P(H_1(n)|x(n),\gamma)=(1+(\gamma+(\gamma+1)(\eta_n^{-1}-1)\exp(-(\gamma+1))|y(n)2|)^{-1} \quad \text{(Eq. 1)}$$

where $H_1(n)$ is the amplitude of the SOI in frequency channel n, x(n) is the amplitude of the jammer signal in frequency channel n, $\eta_n$ is the prior probability, and $\gamma$ is the signal-and-interference-to-noise-ratio (SINR) of the jamming signal. Based on the probability, a specified threshold can be used to determine if the SOU is an interferer attack. The specified threshold in one example is a predetermined value based on simulations and/or actual data.

Figure 2:
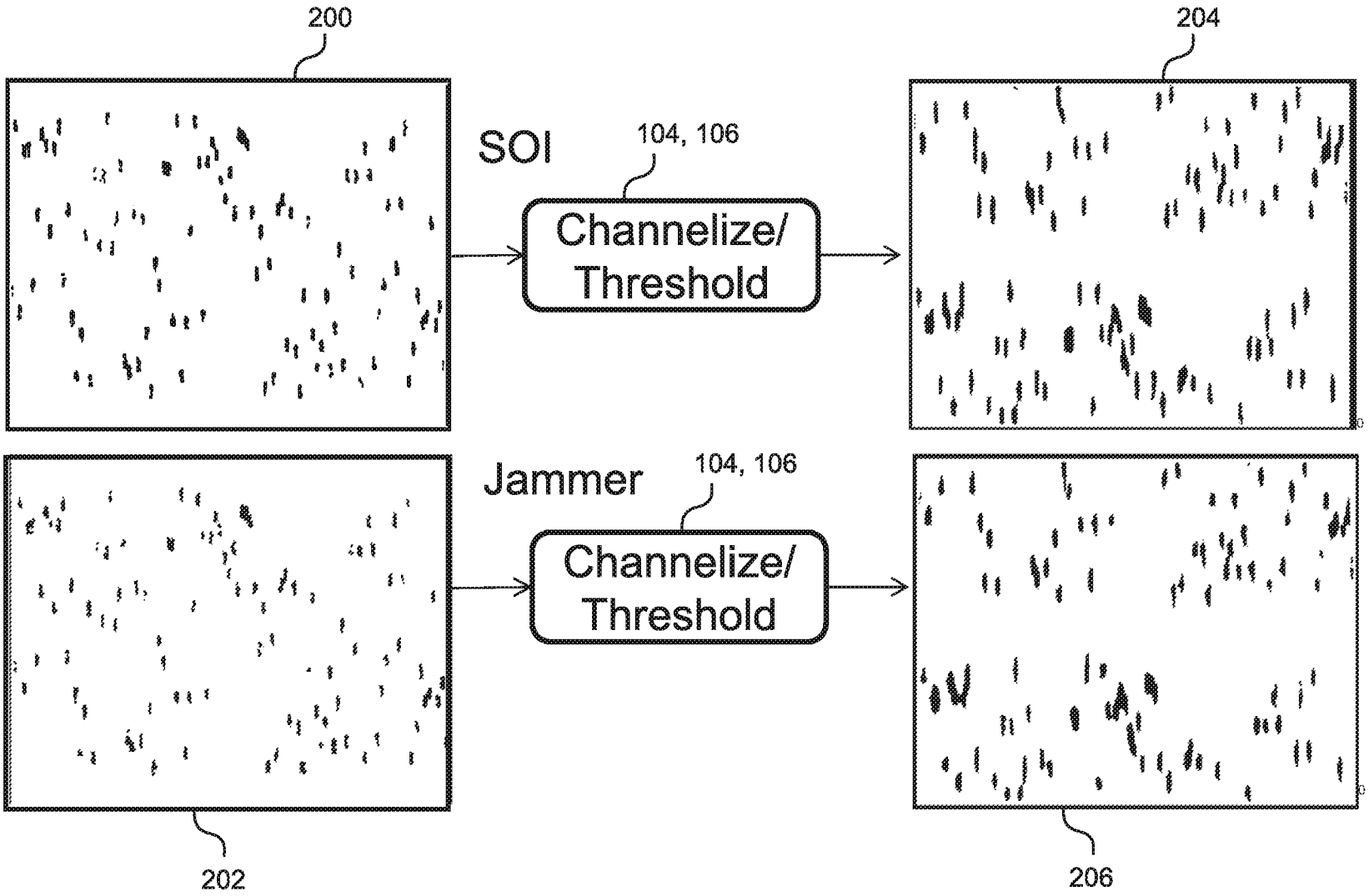
FIG. 2 illustrates the application of a test for a reactive jammer in an embodiment of the present system.

FIG. 2 illustrates a test of the embodiment of FIG. 1 for identifying a reactive jammer. In the test illustrated by FIG. 2, the random hoping of the SOI was in a 200 kHz spread over 5 MHz. The jammer had a 10 μs receive window and a 40 μs transmit window. The jammer had a jamming-wave signal to noise ratio (JWNR) of 20 dB, and the SOI had a 10 dB signal wave to noise ratio (SWNR) with SOI leakage. There was a reactive delay of 102.4 μs. Two dimensional plots of time vs. frequency are presented in the figure for the SOI 200 and the jammer signal 202, as well as the results 204, 206 after the two signals had been channelized 104 and the thresholds had been detected 106.

Figure 3:
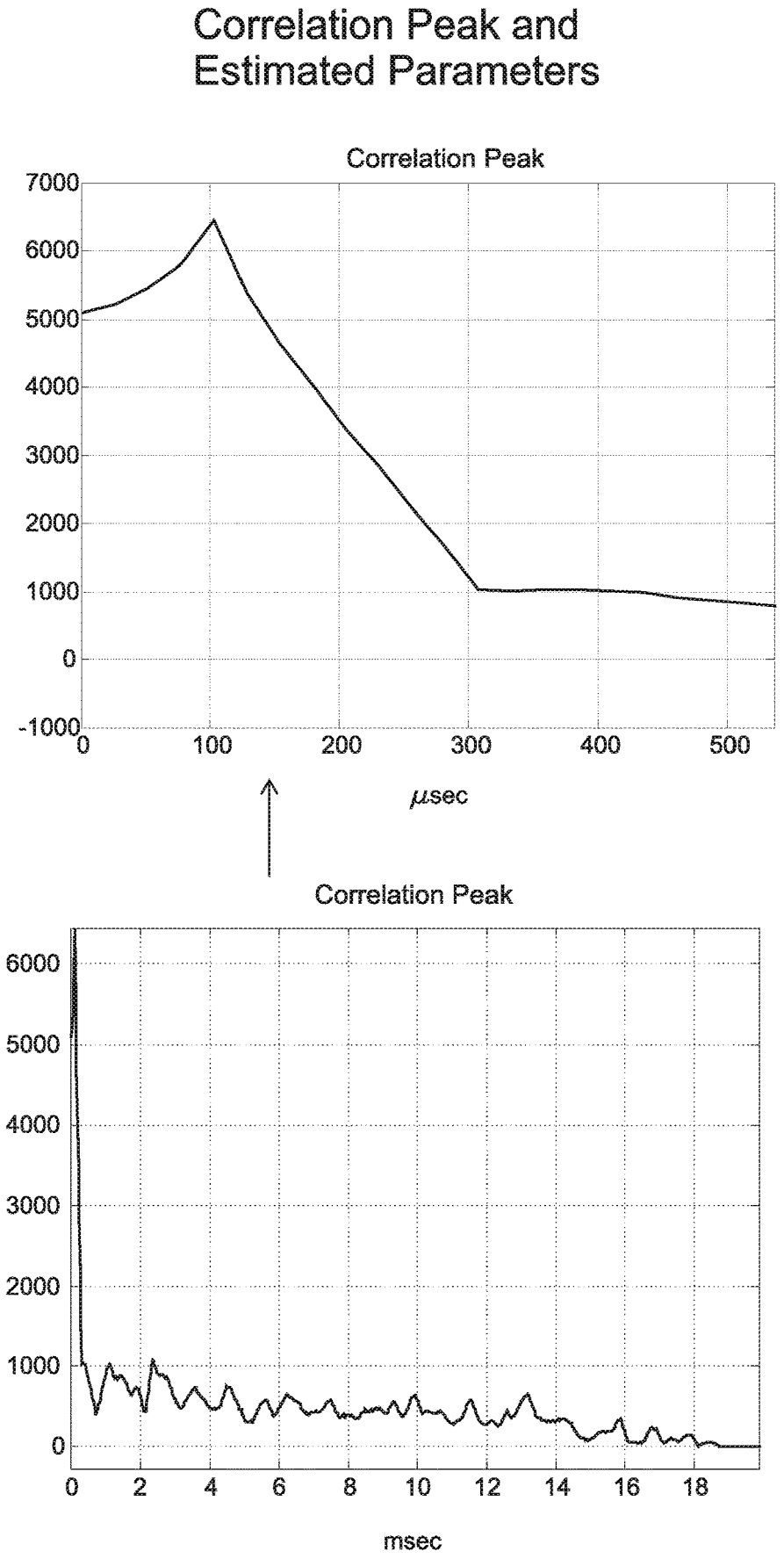
FIG. 3 is a graphical plot of a correlation peak over time in an embodiment of the present system.

FIG. 3 presents two plots of correlation peaks over time for the test presented in FIG. 2, where the upper plot is an expansion of the lower plot. For the example shown in the figure there was a 91% overlap of the SOI and jamming signal, and the system correctly estimated the jamming delay as being 102.4 μs.

Figure 4A:
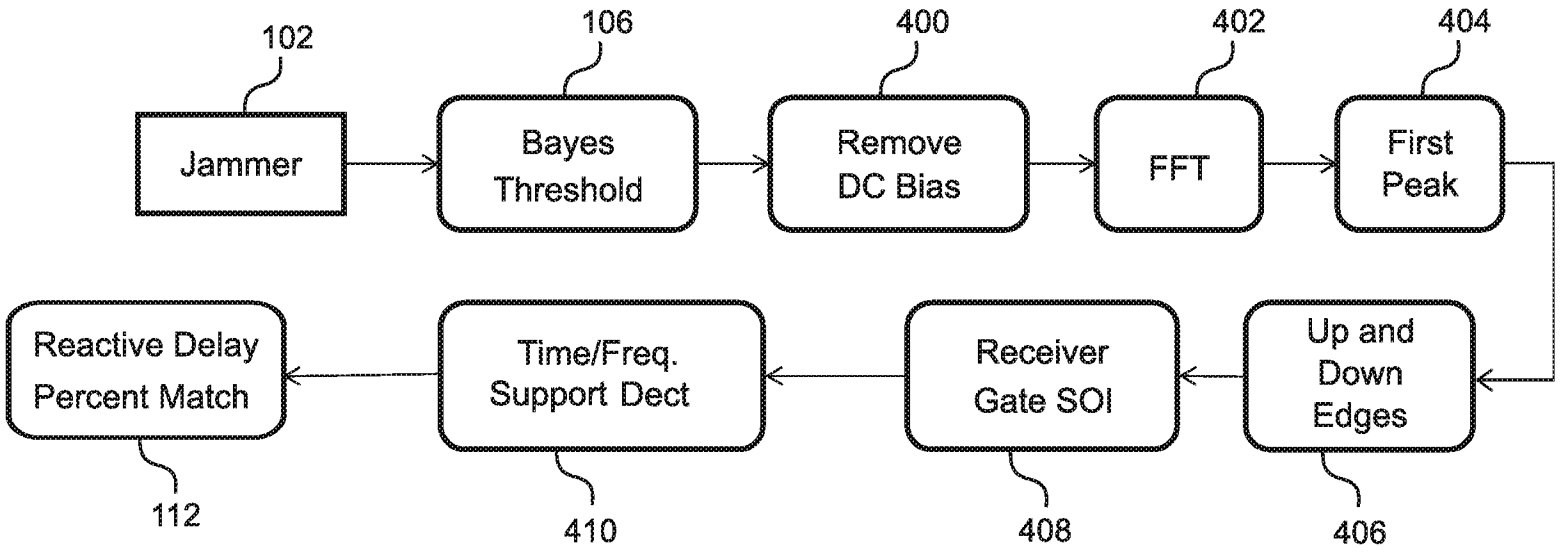
FIG. 4A is a flow diagram that illustrates the operation of an embodiment of the present technique which implements receive gate estimation.

FIG. 4A presents a flow chart outlining a method used in an embodiment of the present system that makes use of an estimated receiver gate period to improve time/frequency support detection. In the illustrated embodiment, the Bayes threshold 106 is used to determine the energy support in the time domain, the DC bias is removed 400, and then a fast Fourier transform (FFT) is performed 402 on the jamming signal.

Figure 4B:
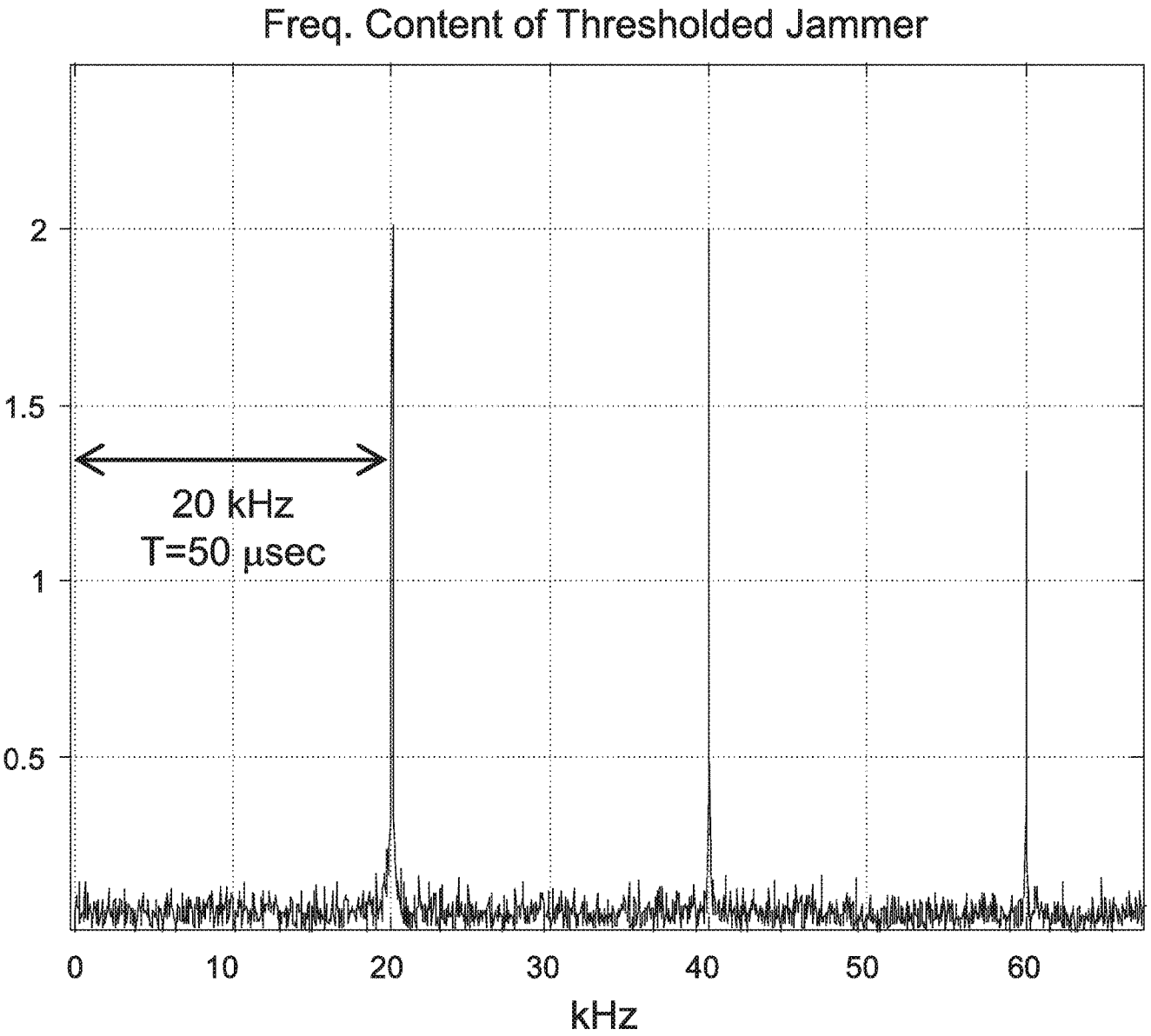
FIG. 4B is a graphical plot of edge detection of FFT peaks at multiples of a jammer receive period.

The result of this FFT 402 is shown in FIG. 4B. A periodic receive gate is assumed, the position of the first peak 404 is used to determine the jamming delay, and edge detection 406 of the frequency peaks is used to obtain an estimate of the jammer receiver gate 408. In the illustrated example, the peaks are separated by 20 kHz, leading to an estimated gate period of 50 microseconds. at multiples of the estimated receiver gate period. This information is then compared with the receiver gate 408 of the SOI so as to enhance the detection of the time/frequency support 410, and thereby to determine the reactive delay and the percent match. In the embodiment of FIGS. 4A and 4B this result is achieved without knowledge of the jammer receive window or SOI leakage.

Embodiments of the present system compare the SOI's time/frequency detection maps to the jammer detector's time/frequency detection maps. In certain embodiments, during the comparison the system is aware of time intervals when the communication system is not sensing the environment. These intervals are usually when the communication systems are transmitting. In certain embodiments, the system does not require prior information regarding the jammer and is capable of comparing various instances of recording and jammer transmitting including, but not limited to, IFFT/FFT, DRFM, detect/follow, and the like.

Figure 5:
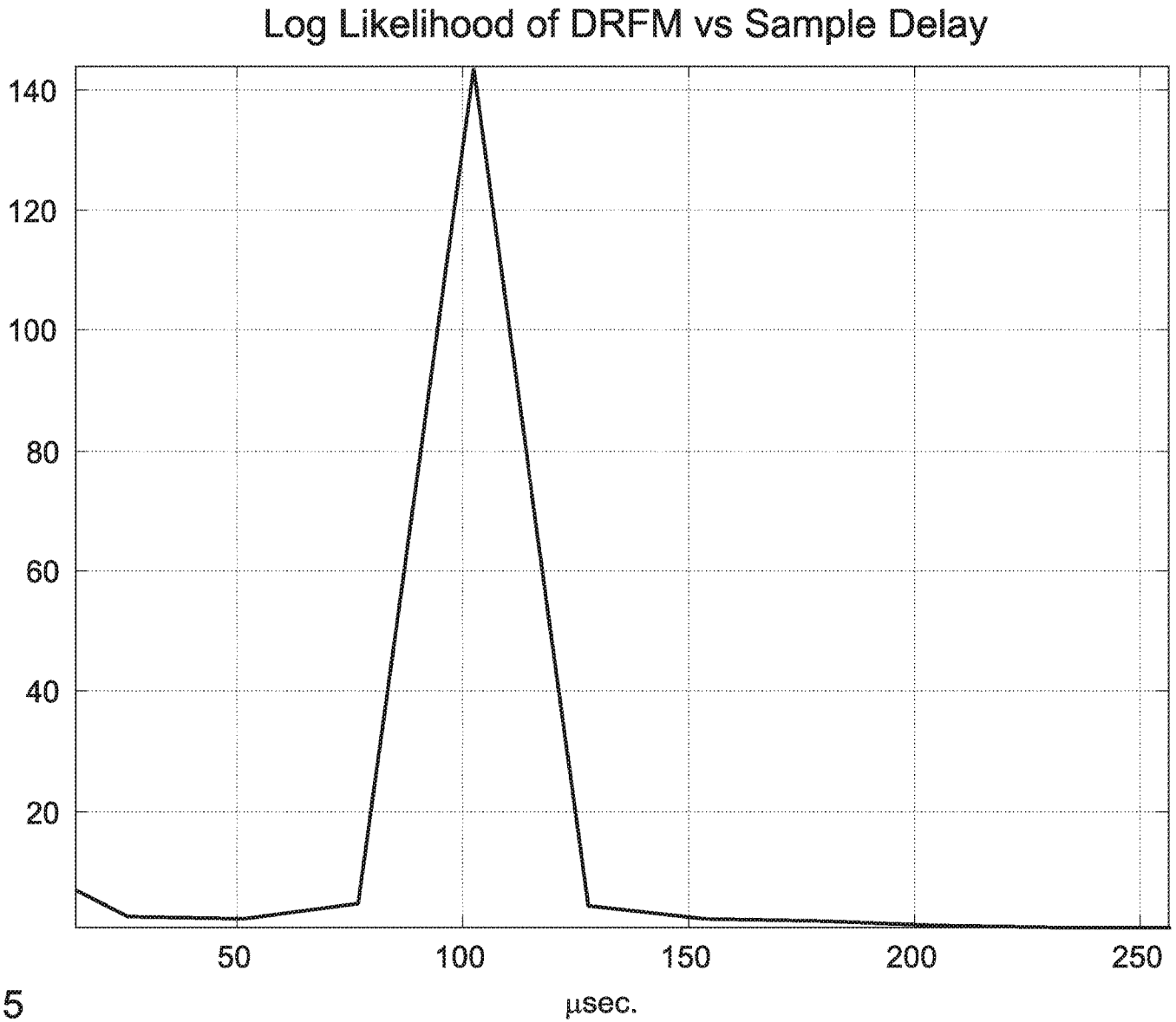
FIG. 5 is a graphical plot of the log likelihood of digital radio frequency memory detection over time in an embodiment of the present system.

FIG. 5 presents a plot of the log likelihood of digital radio frequency memory (DRFM) detection over time, i.e. attacks where the SOI is recorded and played back, in an embodiment of the present techniques. According to the embodiment of FIG. 5, the jammer signal is channelized 104 and time correlated with the SOI over each channel 108. In certain embodiments, a metric (p) is added "incoherently" over each channel, i.e. the amplitudes are added while the phase information is discarded, for example according to the formula:

$$\beta=-\Sigma_k \ln(1-\beta k) \quad \text{(Eq. 2)}$$

where $1-\beta_k$ is the normalized mean square SOI-jammer error for channel k.

In some embodiments, the system can detect DRFM with arbitrary filtering. Embodiments use a hypothesis test over many local frequency shifts to further extend the detection capabilities.

In some embodiments, the system detects replay jammers that are on a fixed schedule. In other embodiments, the system recognizes jammers that have stochastic or irregular listening intervals. In embodiments, the system recognizes jammers that filter or change the received signal, but preserve the time/frequency content of the SOI. In various embodiments, the system provides "look-throughs," i.e. time periods where the transceiver is forced to receive even if it is in a high-duty cycle transmit state and would otherwise have continued to transmit, therefore ensuring that receive time is provided to measure a jamming waveform and thereby aid in jammer behavior estimation. In various embodiments, the system is able to recognize jammers that are not otherwise clearly separable by correlating the SOI with itself when no jamming waveform can be decomposed from the received signal. In some of these embodiments, the zero time offset correlation is ignored and later correlations are considered to determine if they are reactive a tracks or simply multipath reflections.

Figure 6:
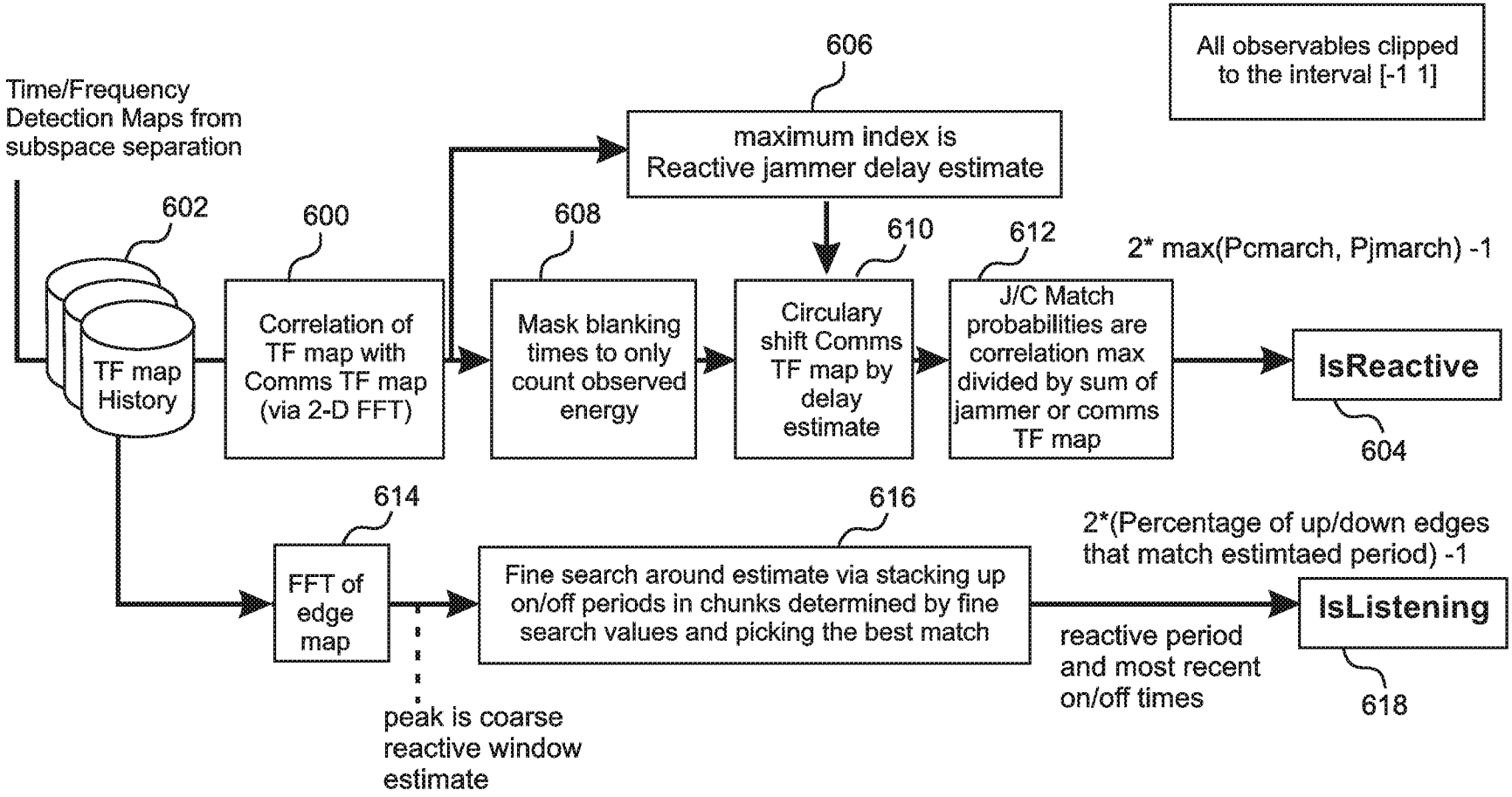
FIG. 6 is a flow diagram that illustrates a channelized detection history correlation system in an embodiment of the present system.

FIG. 6 is a flow diagram of the reactive jammer detection system in an embodiment of the present system. The system utilizes channelized detection history correlation 602 which accumulates beamformed time/frequency detection maps for a signal of interest (SOI) over a plurality of recognizer windows, and correlates 600 that history against accumulated beamformed time/frequency detection maps for all of the interferers present. In certain embodiments, the channelized detection history correlation system 600 evaluates the likelihood that the interferer is reacting 604 to the behavior of the SOI.

In embodiments, the delay at the peak 606 gives the delay of a jammer relative to the SOI. "Unobserved" times (e.g., where the receiver has no information about the jammer because it is transmitting or in a wait state) are weighted 608 to properly compute the likelihoods that the interferer is reacting to the behavior of the SOI. In the embodiment of FIG. 6, the SOI time frequency map is shifted to align with the jammer's 610 based on the reactive delay 606, and then a correlation between the two maps is computed 612 and compared to the sum of each time frequency map to determine an observable termed "isReactive" 604.

In certain embodiments, to find the jammer's listening window, the system evaluates the periodic nature of the jammer's timing. This is achieved coarsely through frequency analysis of the on/off periods 614, followed by refinement in the time domain 616. Embodiments then compute an observable dubbed IsListening 618 which indicates if a periodic receive window has not been identified, implying that the jammer does not remain in a receive state for a predetermined period of time, but instead bases its receive timing on whether or not it has detected energy on the channels it is scanning.

Figure 7:
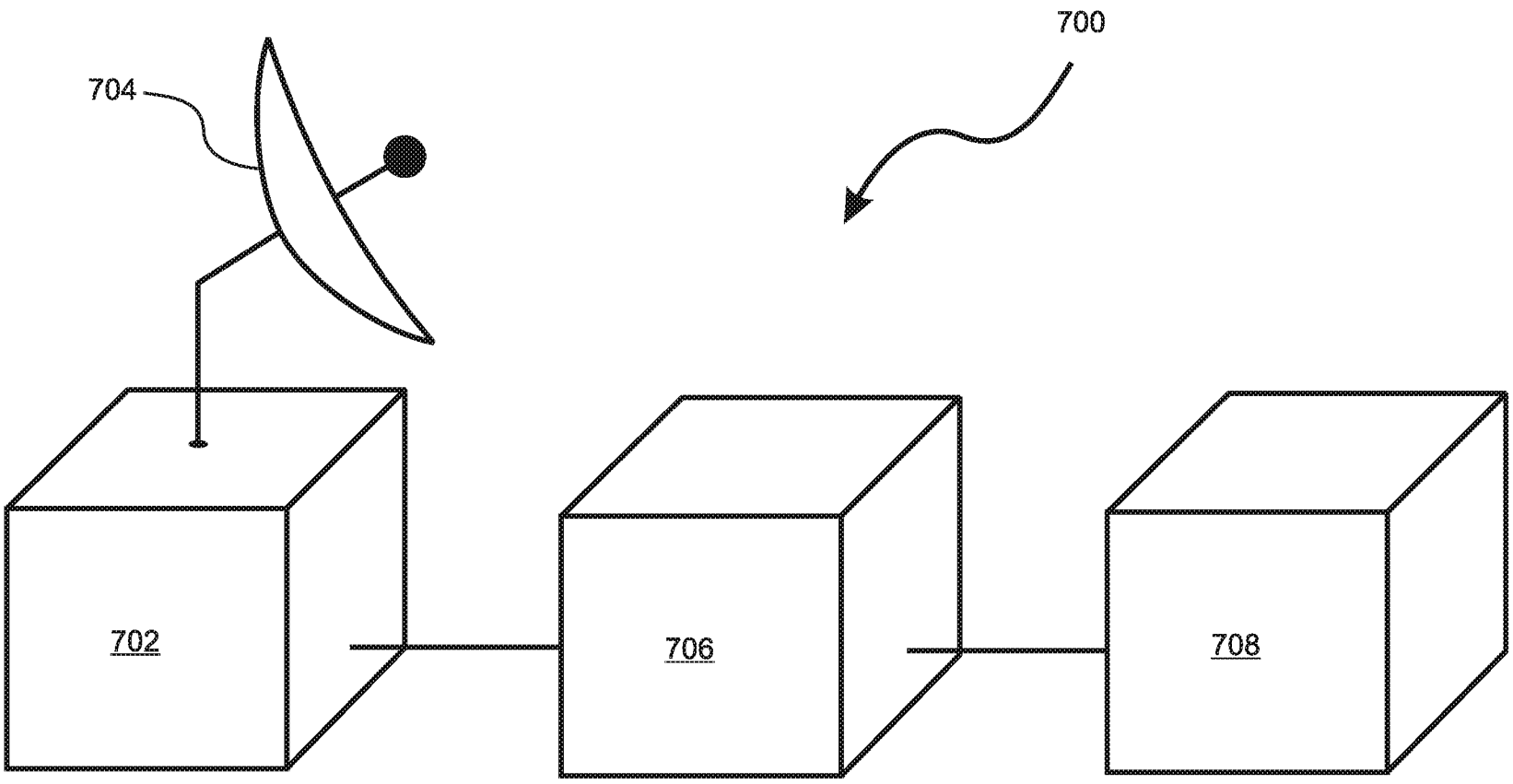
FIG. 7 is a block representation of the elements of the present system according to one embodiment.

FIG. 7 is a simplified illustration of the disclosed system 700, which includes a receiver 702 that receives a signal using at least one antenna 704, the received signal including a signal of interest (SOI) as well as a signal of unknown origin (SUO). The receiver 702 typically comprises elements such as downconverters, amplifiers, analog-to-digital converters, filters, memory, processors and the like. A channelizer 706 then channelizes the SUO and the SOI, and a computing device 708 executes programming instructions that identify frequency support patterns for the SOI and SUO, cross correlate the identified frequency support patterns of the SOI and SUO, and determine therefrom a percentage match. The computing device 708 then determines that the SUO constitutes an interferer attack on the SOI if the percentage match is above a specified threshold, and if the SUO is determined to be an interferer attack, a user is notified of the attack and/or an attack mitigation strategy is implemented. The attack mitigation strategy in one example blocks the signals from interfering and can issue an alert to other systems. In another example, the interferer attack signal can be analyzed to determine a point of origin that can become a target.

It will be understood by one of skill in the art that the modules 702, 706, 708 shown in FIG. 7 represent functional elements of the system 700, and do not necessarily imply the physical arrangement of the system or the locations where the functions are performed. In embodiments, for example, channelizing of the SUO and SOI does not require a dedicated hardware device 706, but instead is accomplished as a digital processing step by the computing device 708. Also, it should be noted that in embodiments a single apparatus performs more than one of the indicated functions, and in some embodiments all of the indicated functions 702, 706, 708 reside within a single, physical apparatus.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One or ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

We claim:

1. A method of analyzing a signal of unknown origin (SUO) so as to determine if it contains an interferer attack on a signal of interest (SOI), the method comprising:

channelizing the SOI;

channelizing the SUO, applying edge detection to the channelized SUO and estimating therefrom a receiver gate period for the SUO;

identifying frequency support patterns for the SOI and SUO and using the estimated SUO receiver gate period to enhance the identification of the SUO frequency support patterns;

cross correlating the identified frequency support patterns of the SOI and SUO, and determining therefrom a percentage match, wherein the cross correlating occurs without prior information about the SUO;

determining if the SUO constitutes the interferer attack on the SOI if the percentage match is above a specified threshold; and if the SUO is determined to be the interferer attack, at least one of sending an alert of the interferer attack and implementing an attack mitigation strategy.

2. The method of claim 1, wherein identifying the frequency support patterns comprises applying Bayes thresholds.

3. The method of claim 1, wherein channelizing the SUO includes adding a metric incoherently over at least one channel of the channelized SUO.

4. The method of claim 3, wherein the metric is given by:

$$\rho=-\Sigma_k \ln(1-\beta k)$$

where $\rho$ is the metric and $1-\beta_k$ is a normalized mean square SOI-jammer error for channel k.

5. The method of claim 1, further comprising:

recording detection map histories for the channelized SOI and SUO; and correlating the detection map histories for the channelized SOI and SUO.

6. The method of claim 5, further comprising determining a likelihood that the interferer attack is reactive to changes in the SOI frequency support pattern.

7. The method of claim 6, further comprising, if the interferer attack is reactive, determining if the reactive interferer attack is anticipatory of the SOI frequency support pattern.

8. The method of claim 6, further comprising estimating a reaction delay of the interferer attack.

9. The method of claim 1, further comprising estimating a periodicity of the interferer attack.

10. The method of claim 1, further comprising determining if the interferer attack includes copying and retransmitting waveforms of the SOT.

11. The method of claim 10, further comprising determining if the interferer attack is at regular intervals.

12. The method of claim 10, further comprising determining if the interferer attack occurs at particular intervals, wherein the particular intervals may be regular or irregular.

13. The method of claim 10, further comprising determining if the interferer attack includes altering the retransmitted waveforms of the SOI before retransmission thereof, while preserving the frequency support pattern thereof.

14. The method of claim 1, wherein determining if the SUO contains the interferer attack includes using a hypothesis test over a plurality of local frequency shifts.

15. The method of claim 1, further comprising providing look-throughs to further enhance characterization of the interferer attack.

16. A system configured for analyzing a signal of unknown origin (SUO) so as to determine if it contains an interferer attack on a signal of interest (SOI), the system comprising:

a receiver configured for detecting the SUO;

at least one channelizer configured to channelize the SUO and the SOI; and a computing device configured to execute programming instructions that:

apply edge detection to the channelized SUO and estimating therefrom a receiver gate period for the SUO;

identify frequency support patterns for the SOI and SUO and using the estimated SUO receiver gate period to enhance the identification of the SUO frequency support patterns;

cross correlate the identified frequency support patterns of the SOI and SUO without prior information about the SUO, and determining therefrom a percentage match;

determine that the SUO constitutes the interferer attack on the SOI if the percentage match is above a specified threshold; and if the SUO is determined to be the interferer attack, at least one of notify a user of the attack and implement an attack mitigation strategy.

17. A non-transitory computer-readable storage medium having an executable program stored thereon for analyzing a signal of unknown origin (SUO) so as to determine if it contains an interferer attack on a signal of interest (SOI), wherein the program instructs a processor to:

channelize the SUO and the SOI of received signals, apply edge detection to the channelized SUO and estimate therefrom a receiver gate period for the SUO;

identify frequency support patterns for the SOI and SUO and using the estimated SUO receiver gate period to enhance the identification of the SUO frequency support patterns;

cross correlate the identified frequency support patterns of the SOI and SUO without prior information about the SUO, and determining therefrom a percentage match;

determine that the SUO constitutes the interferer attack on the SOI if the percentage match is above a specified threshold; and if the SUO is determined to be the interferer attack, at least one of notify a user of the attack and implement an attack mitigation strategy.

* * * * *